United States Patent [19]

Degrave et al.

[11] 4,197,160

[45] Apr. 8, 1980

[54] PROCESS BY MEANS OF WHICH MOULDED COKE CAN BE OBTAINED FROM NON-COKABLE COALS

[75] Inventors: Roger Degrave; Maurice Marchasson, both of Douai, France

[73] Assignee: Houilleres du Bassin du Nord et, Due Pas-de-Calais, Douai, France

[21] Appl. No.: 888,523

[22] Filed: Mar. 21, 1978

[30] Foreign Application Priority Data

Mar. 28, 1977 [FR] France ..... 77 09186

[51] Int. Cl.[2] ..... C10B 47/10; C10B 53/08; C10B 57/04

[52] U.S. Cl. ..... 201/6; 201/8; 201/23; 201/42; 44/10 D; 44/10 G

[58] Field of Search ..... 201/5, 6, 8, 21, 23, 201/24, 42, 44; 44/10 R, 10 D, 10 J, 10 K

[56] References Cited

U.S. PATENT DOCUMENTS

| | | | |
|---|---|---|---|
| 2,825,679 | 3/1958 | Baum | 201/22 X |
| 2,935,450 | 5/1960 | Jully | 201/24 X |
| 3,018,227 | 1/1962 | Baum et al. | 201/23 X |
| 3,883,399 | 5/1975 | Nire | 201/8 X |
| 3,907,648 | 9/1975 | Nire | 201/23 X |
| 3,933,443 | 1/1976 | Lobrmann | 201/21 X |
| 4,073,625 | 2/1978 | Kiritani | 44/10 R |
| 4,110,169 | 8/1978 | Suzuki et al. | 201/23 |

FOREIGN PATENT DOCUMENTS

| | | | |
|---|---|---|---|
| 2613353 | 10/1976 | Fed. Rep. of Germany | 201/5 |
| 2613495 | 10/1977 | Fed. Rep. of Germany | 201/21 |
| 2643635 | 1/1978 | Fed. Rep. of Germany | 201/6 |

*Primary Examiner*—Michael S. Marcus
*Attorney, Agent, or Firm*—Bacon & Thomas

[57] ABSTRACT

Process for the preparation of a moulded coke according to which agglomerates are heated in a non-oxidizing atmosphere, this process being characterized in that the agglomerates are prepared by compression from a paste containing:

from 60 to 85% by weight of non-cokable coals,
from 10 to 30% by weight of agglutinating coals having a swelling index greater than 2, and
from 5 to 13% by weight of binder, which paste, when heated at 6° C. per minute in the ARNU dilatometer gives a contraction of between 3 and 15%, preferably between 5 and 10% and a swelling of zero or near 0, and in that the agglomerates are heated in a non-oxidizing atmosphere from a temperature of about 100° C. to a temperature of at least about 700° C., with a rate of heating of between 7 and 14° C. per minute.

6 Claims, No Drawings

PROCESS BY MEANS OF WHICH MOULDED COKE CAN BE OBTAINED FROM NON-COKABLE COALS

The present invention relates to a process which makes it possible to obtain moulded coke from noncokable coals.

It is known that moulded coke can be produced from various coals;

either by using, after conventional agglomeration, a relatively slow heating rate during the carbonisation of the agglomerates, in particular whilst passing through the pasty fusion range of the coals, which range is located between 350° and 550° C., this slow heating rate being required by the fact that it is desired to preserve the shape of the ovoids after the finished treatment, or by carrying out, after conventional agglomeration, a pre-oxidation of the agglomerates, after which these oxidised ovoids are carbonised, or by carrying out the process in the absence of a binder, but with a moulding process carried out at a temperature at which the mixture of the carbonaceous constituents employed is in its plastic state.

Hitherto, these processes have proved of little value on an industrial scale.

The present invention deals with the difficulties encountered in carrying out the previously known processes and makes it possible to rapidly produce moulded coke possessing valuable industrial properties.

The present invention thus relates to a process for the preparation of moulded coke from non-cokable coals, according to which agglomerates are heated in a non-oxidising atmosphere, this process being characterised in that the agglomerates are prepared by compression from a paste containing:

from 60 to 85% by weight of non-cokable coals, from 10 to 30% by weight of agglutinating coals having a swelling index greater than 2, and from 5 to 13% by weight of binder, which paste, when heated at 6° C. per minute in the ARNU dilatometer gives a contraction of between 3 and 15%, preferably between 5 and 10%, and a swelling of zero or near 0, and in that the agglomerates are heated in a non-oxidising atmosphere from a temperature of about 100° C. to a temperature of at least about 700° C., with a rate of heating of between 7° and 14° C. per minute.

According to the invention, the agglomerates are prepared by "cold compression" of a paste containing 60 to 85% by weight of non-cokable coals. By non-cokable coals there is understood any coal having a swelling index in a crucible, measured according to French Standard Specification M-11, 001, of between 0 and 2, any semi-coke obtained from the same coals or from lignite, and any mixture of these products. Preferably, either a non-cokable coal having a content of volatiles of less than 20% (that is to say coals of classes 100, 200 and 300) or a semi-coke obtained by fluidisation, for example, of non-cokable coal having a high content of volatiles, of classes 400, 500, 600, 700, 800 or 900, or 411, 511, 611, 711, or 811, or 412, 512, 612, 712 or 812, or a lignite semi-coke, or a mixture of these products is used. The semi-coke is prepared at a sufficiently high temperature so that its residual content of volatiles is equal to or less than 25%. The non-cokable coal can be a coal having a swelling index between 0 and ½, semi-coke produced from a non-cokable coal having a swelling index between 0 and 2 or lignite, or a mixture of at least one of the non-cokable coal having a swelling index between 0 and ½ and the semi-coke with a coal having a swelling index between 1 and 2.

According to the invention, from 10 to 30% by weight of agglutinating coals, that is to say coals which have a swelling index in a crucible of greater than 2 are used in a mixture with the non-cokable coals as defined above.

According to the invention, from 5 to 13% by weight of binder is also used to prepare the paste of the agglomerates.

The binder employed can be a coal pitch or a petroleum bitumen, either of which can, depending on the nature of the carbonaceous material employed, have added to it coal tar or lignite tar or a fraction of these tars.

Preferably, coal pitch, which has a higher content of fixed carbon than petroleum bitumen, is used.

The various substances, that is to say the non-cokable coal or coals, the agglutinating coal or coals and, where relevant, the binder, must be ground and mixed so as to form a paste which on moulding will give agglomerates. This grinding will be such that the size of the solid particles is preferably less than about 1 mm; preferably, particles of which at least 90% have a size less than 0.5 mm will be used.

The paste obtained from the ingredients defined above must possess the following specific properties; it must, when subjected to the ARNU dilatometer test, be used at a rate of heating of 6° C. per minute, have a contraction of between 3 and 15%, preferably between 5 and 10%, and a re-swelling of zero or near 0.

The paste is then moulded in accordance with the conventional process, that is to say, for example, at a temperature of the order of 80° C., which temperature can quite obviously depend on the binder used. In this way, preferably using a pressure of 250 kg/cm$^2$, agglomerates which weigh, for example, from 20 to 40 g are produced.

These agglomerates are subsequently heated so that thier internal temperature rises at a speed of between 7° and 14° per minute. It is clear that any method of heating the agglomerates will, bearing in mind their heat conductivity, result in non-uniformity of the internal temperature of these agglomerates; however, experiments have shown that by applying external heating to the agglomerates, the rate of rise of their temperature was able to fall within the range of speeds considered, regardless of the position at which the temperature measurement is carried out. Most frequently, the experiments were carried out by recording the variation of the temperature near the centre of the agglomerate. This heating can be carried out in ovens, using continuous or discontinuous processes, by direct contact with hot walls or with inert products circulating through the ovens and more generally by any known technique which makes it possible to ensure that the agglomerates are heated in accordance with the invention, that is to say at a rate of heating of between 7° and 14° C. per minute. This rate of heating must be applied as from when the agglomerates have reached a temperature of about 100° C. and until their temperature has reached at least about 700° C. The lower temperature as from which this speed of heating must be achieved is about 100° C., because the applicant company has found that below this temperature phenomena which were not of major importance for the subsequent treatment were able to take place. It has thus been found, for example, that in general up to about 100° C. evaporation of the water which may be contained in the agglomerates takes place.

After the temperature of the agglomerates reached about 700° C., it was again found that the rate of heating of these agglomerates was of less importance as far as the properties of the coke obtained were concerned. It will be noted that this temperature of about 700° C. is markedly above the temperature range of pasty fusion of the coals, because this range is between about 350° C. and 550° C. However, it is of course possible and even desirable to continue the heating of the agglomerates beyond 700° C., so as to finish the coking; thus, the agglomerates can be heated to 900°-950° C. or 1000° C. but, as stated before, it is now no longer necessary to maintain the same rate of heating.

According to the invention, it is desirable that the treated agglomerates should be subjected to a similar or identical rate of heating at a rate of 7° to 14° C. per minute, but it is not necessary that the rate of heating should be the same at all temperatures (between about 100° C. and about 700° C. ). The optimum rate of heating can depend partly on technical requirements and on the composition of the agglomerates treated; thus, for example, for agglomerates produced from a paste containing a coal of class 200, a coal of class 433 and a coal pitch, it has been found that the best results corresponded to a rate of heating which is very substantially constant between 100° and 700° C.

The moulded cokes obtained by carrying out the process according to the invention has very valuable properties. Thus, for example, their mechanical strength is very commonly greater than 300 kg/cm$^2$, their hardness indices measured on the MICUM apparatus (that is to say by screening on a 20 mm and a 10 mm sieve and corresponding, on the one hand, to the retention on the 20 mm sieve and, on the other hand, to the material passing through the 10 mm sieve) have the following values:

$M_{20} \geqq 88$
$M_{10} \leqq 9.5$ and furthermore they have a homothetic shape similar to that of the untreated agglomerates and their surface does not exhibit cracks, blisters and deep crazing which are very commonly encountered in moulded cokes prepared according to the previously known processes.

The non-limiting examples which follow illustrate the invention.

EXAMPLE 1

In order to obtain a mixture having the following ARNU characteristics at a rate of heating of 6°/minute: 5% contraction and 0 swelling, 20 g agglomerates, pressed at 250 kg/cm$^2$ were prepared, which comprises 79% of lean coal with 11% of volatiles, classification No. 200, 14% of fat coal with 25% of volatiles, classification No. 433, having a swelling index of 8, and 7% of coal pitch having a Kraemer-Sarnov index of 70 and a C content of 45%.

After grinding, the particle size of the paste was as follows:

55% < 0.025 mm
90% < 0.5 mm
100% < 1 mm

After treatment at a heating rate of between 7° and 10°/minute from 70° to 850° C., a moulded coke having the following characteristics was obtained:

% of intact ovoids > 96%
Mechanical strength > 300 kg/cm$^2$
MICUM indices:
M 20 = 93
M 10 = 6.7

EXAMPLE 2

In order to obtain a mixture having the following ARNU characteristics at a rate of heating of 6°/minute: 7.5% concentration and 0 swelling, 20 g agglomerates, pressed at 250 kg/cm$^2$ were prepared, which comprises 65% of lean coal with 11% of volatiles, classification No. 200, 28% of bituminous fat coal with 38.5% of volatiles, classification No. 621, having a swelling index of 3, and 7% of coal pitch having a Kraemer-Sarnov index of 70, the particle size of the paste being the same as in Example 1.

After treatment at a heating rate of between 7° and 10°/minute from 75° to 850° C., a moulded coke having the following characteristics was obtained:

% of intact ovoids > 96%
mechanical strength > 300 kg/cm$^2$
MICUM indices:
M 20 = 92
M 10 = 6.6

EXAMPLE 3

The agglomerates corresponding to Formulation II (Example 2) were treated at a different rate of heating:

In spite of the proportion of intact ovoids being identical the preceding examples, the MICUM results were less valuable 3.1. with a rate of heating of between 2.5 and 6°/minute, the results were as follows:
M 20 = 87
M 10 = 11.5

3.2. with a rate of heating of between 9° and 16.5°/minute, the results were as follows:
M 20 = 70
m 10 = 12

EXAMPLE 4

In order to obtain a mixture having the following ARNU characteristics at a rate of heating of 6°/minute:
10% contraction and
0 swelling,
30 g agglomerates were prepared, comprising 71% of semi-coke with 24% of volatiles, originating from the fluidisation treatment of, on the one hand, a coal of international classification No. 800 and, on the other hand, a lignite, 17.5% of fat coal with 25% volatiles, classification No. 433, 7.3% of coal pitch and 4.2% of tar.

On applying an identical treatment to that of Examples 1 and 2, that is to say a rate of heating of between 8° and 10°/minute up to 850° C., a moulded coke which also had valuable characteristics was obtained.

% of intact ovoids > 97%
mechanical strength about 300 kg/cm$^2$
M 20 > 88; m 10 < 9.5.

What is claimed is:

1. In a process for the preparation of a moulded coke wherein there are heated from a temperature of about 100° C. to a temperature of at least about 700° C. at a rate of between 7° C. and 14° C. per minute, agglomerates prepared by compression from a paste which is a mixture of from 60%–85% by weight of non-cokable coal selected from the group consisting of coal having a content of volatiles less than 20% and a swelling index between 0 and ½, semi-coke having a content of volatiles less than 25% produced from a non-cokable coal having a swelling index between 0 and 2 or lignite and a mixture of at least one of said coal having a swelling index between 0 and ½ or said semi-coke with coals having a swelling index between 1 and 2; from 10%–30% by weight of agglutinating coal having a swelling index greater than 2 and from 5%–13% by weight of a binder, the improvement of mixing said non-cokable coal and agglutinating coal in such proportion within the stated ranges that said paste, when heated at 6° C. per minute in the ARNU dilatometer, gives a contraction of between 3% and 15% and a swelling of zero or nearly zero, thereby producing a moulded coke having a mechnical strength greater than 300 kg/cm$^2$, hardness indices $M_{20}>88$ and $M_{10}<9.5$ as measured on the MICUM apparatus, a shape similar to that of the untreated agglomerates and a surface which does not exhibit cracks, blisters and deep crazing.

2. A process as claimed in claim 1 in which the binder consists of coal pitch.

3. A process as claimed in claim 1 in which the coals are finely ground so as to have a particle size of less than about 1 mm.

4. A process as claimed in claim 1 in which the agglomerates have, before coking, a weight of between about 20 and 40 g.

5. A process as claimed in claim 1 in which the rate of heating is substantially uniform between 100° and 700° C.

6. A process as claimed in claim 1 in which the heating of the agglomerates is continued beyond the temperature of 700° C. so as to complete the coking of the said agglomerates.

* * * * *